US007128791B2

(12) United States Patent
Horiuchi et al.

(10) Patent No.: US 7,128,791 B2
(45) Date of Patent: Oct. 31, 2006

(54) HEAT-RESISTANT MARTENSITE ALLOY EXCELLENT IN HIGH-TEMPERATURE CREEP RUPTURE STRENGTH AND DUCTILITY AND PROCESS FOR PRODUCING THE SAME

(75) Inventors: Toshiaki Horiuchi, Ibaraki (JP); Masaaki Igarashi, Osaka (JP); Fujio Abe, Ibaraki (JP)

(73) Assignees: National Institute for Materials Science, Ibaraki (JP); Sumitomo Metal Industries, Ltd., Osaka (JP); Hitachi, Ltd., Tokyo (JP)

( * ) Notice: Subject to any disclaimer, the term of this patent is extended or adjusted under 35 U.S.C. 154(b) by 112 days.

(21) Appl. No.: 10/240,176

(22) PCT Filed: Jan. 30, 2002

(86) PCT No.: PCT/JP02/00776

§ 371 (c)(1),
(2), (4) Date: Mar. 13, 2003

(87) PCT Pub. No.: WO02/061162

PCT Pub. Date: Aug. 8, 2002

(65) Prior Publication Data

US 2004/0057862 A1 Mar. 25, 2004

(30) Foreign Application Priority Data

Jan. 31, 2001 (JP) ..... 2001-023635

(51) Int. Cl.
*C22C 38/18* (2006.01)

(52) U.S. Cl. ..... 148/325; 148/333; 420/106; 420/64

(58) Field of Classification Search ..... 420/37, 420/64, 106, 36; 148/325, 663, 333
See application file for complete search history.

(56) References Cited

U.S. PATENT DOCUMENTS 5,911,842 A * 6/1999 Shiga et al. ..... 148/325

FOREIGN PATENT DOCUMENTS

| | | |
|---|---|---|
| EP | 887431 | 12/1998 |
| EP | 1103626 | 5/2001 |
| JP | 4-173926 | 6/1992 |
| JP | 11-350031 | 12/1999 |
| JP | 2000-026940 | * 1/2000 |
| JP | 2000-204434 | 7/2000 |

* cited by examiner

*Primary Examiner*—Scott Kastler
(74) *Attorney, Agent, or Firm*—Wenderoth, Lind & Ponack, L.L.P.

(57) ABSTRACT

The present invention provides a martensitic heat resistant alloy having a composition (A) comprising, % by weight: 0.03 to 0.15% of C; 0.01 to 0.9% of Si: 0.01 to 1.5% of Mn; 8.0 to 13.0% of Cr; 0.0005 to 0.015% of Al; no more than 2.0% of Mo; no more than 4.0% of W; 0.05 to 0.5% of V; 0.01 to 0.2% of Nb; 0.1 to 5.0% of Co; 0.008 to 0.03% of B; less than 0.005% of N: and Fe and inevitable impurities as the remainder, wherein (B) the contents (% by weight) of Mo, W, B and N satisfy the following formulae (1) and (2).

$$B-0.772N>0.007 \quad (1)$$

$$W+1.916Mo-16.99B>2.0 \quad (2)$$

The martensitic heat resistant alloy of the present invention has excellent oxidation resistance, hot workability and ductility and exhibits high creep rupture strength in a range of relatively long rupture time at a high temperature.

15 Claims, 5 Drawing Sheets

HEAT-RESISTANT MARTENSITE ALLOY EXCELLENT IN HIGH-TEMPERATURE CREEP RUPTURE STRENGTH AND DUCTILITY AND PROCESS FOR PRODUCING THE SAME

TECHNICAL FIELD

The present invention relates to a martensitic heat resistant alloy being excellent in creep rupture strength at a high temperature and ductility, and a method for producing the same. More specifically, the present invention relates to a martensitic heat resistant alloy exhibiting excellent creep rupture strength in a range of relatively long rupture time at a high temperature, being excellent in oxidation resistance as well an hot workability and ductility, and a method for producing the same.

BACKGROUND ART

In the conventional martensitic heat resistant alloy, the content of B is generally controlled to be in a range of: 0.008% by weight or less and the content of N is generally controlled to be in a range of 0.02 to 0.06% by weight. The content of N is set in the above-mentioned range because: N is an element which is naturally mixed into the alloy from raw steel or atmosphere and the element is inevitably contained in the alloy by the content of 0.02% by weight or so, regardless of any attempt to remove it; the presence of N in the alloy results in precipitation of carbonitrides of Nb and V, thereby enhancing the creep strength of the alloy; when the content of N is added in such large quantity as exceeds 0.1% by weight, the creep rupture ductility, welding property and workability are deteriorated; and the presence of N in the alloy is rather preferable as long as the content thereof does not exceed 0.06% by weight.

With regards to B, B contained in the alloy has an effect of minutely dispersing precipitates and suppressing the growth thereof, thereby stabilizing grain boundaries. Therefore, addition of B by a very small content significantly enhances the creep rupture strength. However, as B exhibits a strong affinity with N, addition of B by a large content results in the precipitation of itself as BN, whereby the effects, by B and N, of improving the characteristics of the alloy are all lost, and the welding property and workability of the alloy are significantly deteriorated. Due to this, in the conventional, the content of B in the alloy is reduced to an extremely small value of 0.008% by weight or less, in consideration of the content of N.

On the other hand, Japanese Patent Application Laid-Open (JP-A) Nos. 6-10041, 8-218154, 8-22583 and 9-122971 disclose a ferritic heat resistant steel or a martensitic heat resistant steel and welding materials thereof, to which a relatively large amount of B has been added. However, in any of these references, the content of B has still to be limited due to the reason described above, and the B content thereof remains insufficient with respect to the N content. Thus, the effect of drastically enhancing the creep rupture strength by adding B, which effect would be obtained if the B were to be added by a sufficient content and work without being disturbed by N, were not achieved yet.

JP 8-294793A discloses a welding material for a ferritic steel containing Al of specific type, a relatively large amount of B and a small amount of N. However, the workability and the like of the material disclosed in JP 8-294793A are not fully satisfactory. Further, the material does not achieve a sufficiently high creep strength in a range of relatively long rupture time at a high temperature.

Further, in recent years, JP 11-12693A has proposed an attempt to maximize the effect of addition of B by decreasing the content of N as much as possible. However, in JP 11-12693A, the added amount of B is still insufficient with respect to the added amount of N and the characteristic-improving effect by 9 is not fully exhibited. Thus, high creep strength in a range of relatively long rupture time at a high temperature cannot be achieved.

The present invention has been contrived in consideration of the problems as described above. On object of the present invention is to provide a martensitic heat resistant alloy which solves the problems of the prior art, maximizes the characteristic-improving effect by the presence of B of a large content, has high creep rupture strength in a range of relatively long rupture time at a high temperature, has excellent oxidation resistance, hot workability and ductility. The present invention also aims at providing a method for producing such a martensitic heat resistant alloy.

DISCLOSURE OF INVENTION

The present invention has been achieved in consideration of the tasks as described above, solve the problems of the prior art, provides following aspects.

Specifically, a first aspect of the present invention provides a martensitic heat resistant alloy having a composition (A) including, % by weight: 0.03 to 0.15% of C; 0.01 to 0.9% of Si; 0.01 to 1.5% of Mn; 8.0 to 13.0% of Cr; 0.0005 to 0.015% of Al; no more than 2.0% of Mo; no more than 4.0% of W; 0.05 to 0.5% of V; 0.01 to 0.2% of Nb; 0.1 to 5.0% of Co; 0.008 to 0.03% of B; less than 0.005% of N: and Fe and inevitable impurities as the remainder, wherein (B) the contents (% by weight) of Mo, W, B and N satisfy the following formulae (1) and (2).

$$B-0.772N>0.007 \quad (1)$$

$$W+1.916Mo-16.99B>2.0 \quad (2)$$

A second aspect of the present invention provides a martensitic heat resistant alloy having a composition (A) including, % by weight: 0.03 to 0.15% of C; 0.01 to 0.9% of Si; 0.01 to 1.5% of Mn; 8.0 to 13.0% of Cr: 0.0005 to 0.015% of Al; no more than 2.0% of Mo; no more than 4.0% of W; 0.05 to 0.5% of V; 0.01 to 0.2% of Nb; 0.1 to 5.0% of Co; 0.008 to 0.03% of B; less than 0.005% of N: and Fe and inevitable impurities as the remainder, wherein (B) the mole-based ratio of the content of B with respect to the content of Al (B/Al) is no smaller than 2.5. A third aspect of the present invention provide a martensitic heat resistant alloy having a composition (A) including, % by weight: 0.03 to 0.15% of C: 0.01 to 0.9% of Si: 0.01 to 1.5% of Mn; 8.0 to 13.0% of Cr; 0.0005 to 0.015% of Al; no more than 2.0% of Mo; no more than 4.0% of W; 0.05 to 0.5% of V: 0.01 to 0.2% of Nb; 0.1 to 5.0% of Co; 0.008 to 0.03% of B; less than 0.005% of N: and Fe and inevitable impurities as the remainder, wherein (B) the contents (% by weight) of Mo, W, B and N satisfy the following formulae (1) and (2), $$B-0.772N>0.007 \quad (1)$$

$$W+1.916Mo-16.99B>2.0 \quad (2)$$

The mole-based ratio of the content of B with respect to the content of Al is no smaller than 2.5.

Further, a fourth aspect of the present invention provides the martensitic heat resistant alloy, according to any one of the aforementioned aspects, comprising, % by weight, at least one type of element selected from the group consisting of: no more than 0.1% of Ni; and no more than 0.1% of Cu. A fifth aspect of the present invention provides the martensitic heat resistant alloy, according to any one of the aforementioned aspects, comprising, % by weight, no more than 0.03% of P; no more than 0.01% of S; and no more than 0.02% of O.

Yet further, a sixth aspect of the present invention provides a method for producing a martensitic heat resistant alloy, comprising the steps of: subjecting an alloy material having the composition described in any of the aforementioned aspects to a normalizing process in which the alloy material is heated to a temperature in a range of 1050 to 1200° C., retained therein and cooled, and then subjecting the alloy material to a tempering process in which the alloy material in heated to a temperature in a range of 750 to 850° C., retained therein and cooled.

BEST MODE FOR CARRYING OUT THE INVENTION

Figure 1:
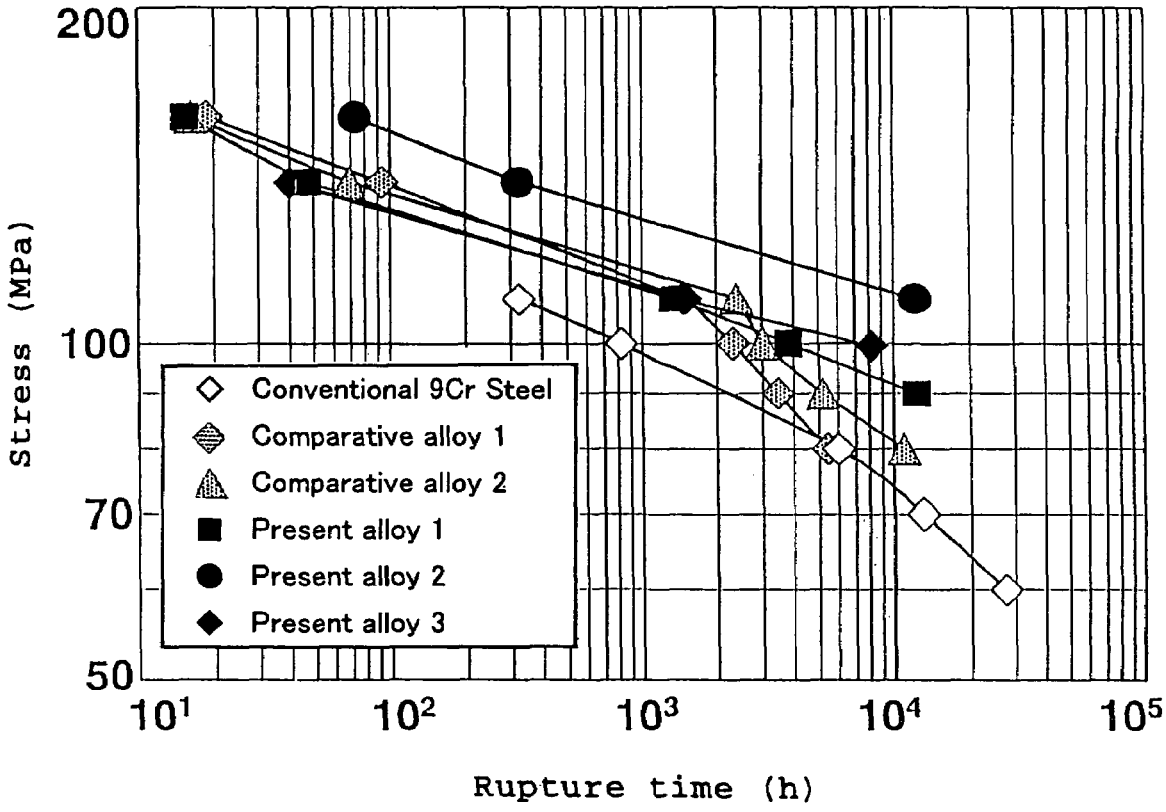
FIG. 1 is a graph showing the correlation between stress and creep rupture time, in an alloy according to the present invention and a comparative alloy, respectively.

One embodiment of the invention of the present application, having the aspects as described above, will be described in detail hereinafter.

The martensitic heat resistant alloy of the first aspect of the invention of the present application has a composition (A) including, % by weight:

0.03 to 0.15% of C:
0.01 to 0.9% of Si;
0.01 to 1.5% of Mn;
8.0 to 13.0% of Cr;
0.0005 to 0.015% of Al;
no more than 2.0% of Mo;
no more than 4.0% of W;
0.05 to 0.5% of V;
0.01 to 0.2% of Nb;
0.1 to 5.0% of Co;
0.008 to 0.03% of B;
less than 0.005% of N: and
Fe and inevitable impurities as the remainder, wherein (B) the contents (% by weight) of Mo, W, B and N satisfy the following formulae (1) and (2).

$$B-0.772N>0.007 \quad (1)$$

$$W+1.916Mo-16.99B>2.0 \quad (2)$$

The composition (A) described above has been designed so that the effect by B addition is maximized by reducing the N content to an extremely low level and increasing the B content to a relatively high level, as compared with the composition of known heat resistant alloys. That is, by reducing the N content and increasing the B content to a relatively high level, loss of B as a result of BN precipitation is prevented and the size of the precipitates is made minute by B, whereby the grain boundaries are stabilized and the creep strength of the alloy in a range of relatively long time at a high temperature is drastically enhanced.

However, in a case in which Mo and W are contained in the alloy as solid solution/precipitation hardening elements, it is known that the solid solution/precipitation hardening mechanism of Mo and w is lost as a result of the excessive addition of B, even it the content of N is low. The inventors of the present application have discovered that such loss of solid solution/precipitation hardening mechanism of Mo and W is caused by precipitation of a boride of $Fe(Mo, W)_2B_2$ type (the boride is presumably a subspecies of the compound of JCPDS card No. 210437). As this boride is very stable (the melting point thereof is presumably 2000° C. or higher), it is impossible to completely decompose this compound by a heat processing or the like. In the present invention, in order to solve the aforementioned problem of precipitation of the boride a method is proposed which necessitates neither expensive elements nor specific production technique and solves the problem by simply improving the prior art i.e., by using basically the same components as the conventional method. Specifically, when the B content is increased, the contents of Mo and W are adjusted accordingly, so as to correspond to the B content.

Thus, in the martensitic heat resistant alloy of the invention of the present application, from the viewpoint of reducing the N content in the alloy and increasing the B content to a high level so that the effect by B addition is maximized, and the viewpoint of adjusting the Mo and W content to a level matching the B content, the composition of the alloy is restricted to the composition range of the aforementioned composition (A) and the optimum composition balance is further defined by the formulae (1) and (2) of the aforementioned (B).

The composition of the martensitic heat resistant alloy of the invention of the present application will be described in detail hereinafter.

The content of C is set in a range of 0.03 to 0.15% by weight. C is an austenite former, which stabilizes martensite and forms carbides, thereby contributing to enhancing the strength of the alloy. When the C content is less than 0.03% by weight, precipitation of carbides is insufficient and satisfactory strength of the alloy cannot be obtained. When the C content exceeds 0.15% by weight, the alloy is significantly hardened, whereby welding property and workability sharply deteriorate. The C content is more preferably in a range of 0.05 to 0.12% by weight.

The content of Si is set in a range of 0.01 to 0.9% by weight. Si is an important element for obtaining oxidation resistance. Si also functions as a deoxidizing agent. When the Si content is less than 0.01% by weight, the alloy cannot have oxidation resistance at a sufficient level. When the Si content exceeds 0.9% by weight, not only toughness of the alloy deteriorates but also the size of the precipitation is made larger, whereby the creep rupture strength is significantly deteriorated. The content of Si is more preferably in a range of 0.2 to 0.6% by weight.

The content of Mn is set in a range of 0.01 to 1.5% by weight. In the alloy of the present application in which a decrease in the content of Al, which functions as a deoxidizing agent, is intended, Mn is an important element which functions as a deoxidizing agent in place of Al. In terms of maintaining the strength of the alloy at a sufficient level, the Mn content must be 0.01% by weight or more. However, when the Mn content exceeds 1.5% by weight, the creep rupture strength deteriorates. The Mn content is more preferably in a range of 0.3 to 0.7% by weight.

The content of Cr is set in a range of 8.0 to 13.0% by weight. Cr is an element, which is essential for making the alloy with sufficient oxidation resistance. Further, Cr forms carbides, thereby making contribution to increasing the strength of the alloy. When the Cr content is less than 8.0% by weight, the alloy cannot be made with sufficient oxidation resistance. When the Cr content exceeds 13.0% by weight, the amount of formation of δ ferrite increases, and the strength and toughness of the alloy are decreased. The Cr content is more preferably in a range of 8.5 to 12.0% by weight, and further more preferably in a range of 8.5 to 10.5% by weight.

The content of Al is set in a range of 0.0005 to 0.015% by weight. Al is an important element as a deoxidizing agent, and it is necessary that the Al content is no less than 0.0005% by weight. However, when the Al content exceeds 0.015% by weight, the creep rupture strength of the alloy is significantly deteriorated. The Al content is more preferably in a range of 0.0005 to 0.01% by weight.

The content of Mo is set in a range of 2.0% by weight or less. Mo is a solid solution hardening element and forms carbides, thereby making contribution to increasing the strength of the alloy. However, when the Mo content exceeds 2.0% by weight, the precipitation of an intermetallic compound is facilitated, whereby the strength and toughness of the alloy are deteriorated. The Mo content is more preferably in a range of 0.001 to 0.05% by weight.

The content of W is set in a range of 4.0% by weight or less. W is, similar to Mo, a solid solution hardening element and forms carbides, thereby making contribution to increasing the strength of the alloy. When the W content exceeds 4.0% by weight, the precipitation of an intermetallic compound is facilitated, whereby the strength and toughness of the alloy are significantly deteriorated. The W content is more preferably in a range of 2.5 to 3.5% by weight.

The content of V is set in a range of 0.05 to 0.5% by weight. V is a solid solution hardening element and forms minute carbonitrides, thereby making contribution to increasing the strength of the alloy. When the V content is less than 0.05% by weight, carbonitrides are not sufficiently precipitated and satisfactory strength of the alloy cannot be obtained. On the contrary, when the V content exceeds 0.5% by weight, carbonitrides are excessively formed and the toughness of the alloy is deteriorated. The V content is more preferably in a range of 0.15 to 0.25% by weight.

The content of Nb is set in a range of 0.01 to 0.2% by weight. Nb is, similar to v, forms minute carbonitrides, thereby making contribution to increasing the strength of the alloy. Therefore, it is necessary that Nb is added to the alloy so that the Nb content is no less than 0.01% by weight. The effect achieved by Nb addition can be more increased by adding V at the same time. However, when the Nb content exceeds 0.2% by weight, carbonitrides are excessively formed and the toughness and welding property of the alloy are deteriorated. The Nb content is more preferably in a range of 0.02 to 0.08% by weight.

The content of Co is set in a range of 0.1 to 5.0% by weight. As Co suppresses the formation of δ ferrite and stabilizes martensite, it is necessary that Co is added to the alloy so that the Co content is no less than 0.1% by weight. When the Co content exceeds 5%, not only the creep rupture strength is rather deteriorated but also the production of the alloy is no longer economical because Co is an expensive element. The Co content is preferably in a range of 0.5 to 3.5% by weight, and more preferably in a range of 2.5 to 3.5% by weight.

The content of B is characteristically set in a range of 0.008 to 0.03% by weight. B minutely disperses the precipitates and suppresses the growth of the precipitates, thereby stabilizing the grain boundaries. When BN is formed, not only the characteristic-improving effects by B and N are both lost but also the welding property and workability of the alloy are significantly deteriorated. However, in the alloy of the invention of the present application, as the content of N has been decreased, the creep strength of the alloy can be drastically enhanced by increasing the B content to 0.008% by weight or more. It should be noted that, when the B content exceeds 0.03% by weight, borides are excessively formed and the toughness, workability and welding property of the alloy are significantly deteriorated. The B content is more preferably in a range of 0.008 to 0.015% by weight.

The content of N is characteristically set in less than 0.005% by weight. N is a solid solution hardening element and forms carbonitrides, thereby making contribution to increasing the strength of the alloy. However, in a case in which the B content is relatively high as in the alloy of the invention of the present application, high content of N which exceeds 0.005% by weight facilitates formation of BN, and not only the characteristic-improving effects by B and N are both lost but also the welding property and workability of the alloy are significantly deteriorated. The N content is more preferably in a range of 0.0005 to 0.004% by weight.

Further, the contents (% by weight) of Mo, W, B and N satisfy the following formulae (1) and (2), $$B-0.772N>0.007 \quad (1)$$

$$W+1.916Mo-16.99B>2.0 \quad (2)$$

The formula (1) is a relational expression, representing the balance of the B and N contents in a form in which the B and N masses are each converted to a mole-based value. When the contents of B and N satisfy the formula (1), the alloy can obtain the excellent creep property. In the formula (1), the coefficient 0.772 of the left-hand side represents the mole-based ratio of B to N (10.82/14.01). In short, it is intended by the formula (1) that the N content is sufficiently decreased with respect to the B content, so that a significant amount of B which contributes to increasing the creep rupture strength is remained in the alloy, even after the effective content of B is decreased as a result of formation of BN. specifically, the B and N contents are prescribed so that the B content exceeds the N content by 0.007% when the B and N masses are each converted to a mole-based value. The right-hand side of the formula (1), i.e., the B content (% by weight) which contributes to increasing the creep rupture strength is preferably in a range of 0.007 to 0.02, and more preferably in a range of 0.007 to 0.015.

Similarly, the formula (2) is a relational expression, representing the balance of the W, Mo and B contents in a form in which the W, Mo and B masses are each converted to a mole-based value. In the formula (2), the coefficients 1.916 and 16.99 of the left-hand side represent the mole-based ratio of W to Mo (183.86/95.95) and the mole-based ratio of W to B (183.86/10.82), respectively. In short, it is intended by the formula (2) that, if a boride of Fe(Mo, W)$_2$B$_2$ type is precipitated as a result of an increase in the B content and thus W and Mo, which contribute to increasing strength of the alloy, are lost, the solid solution/precipitation hardening mechanism of W and Mo remains as long as the W, Mo and B contents satisfy the formula (2). Specifically, the W, Mo and B contents are prescribed so that the W and Mo contents exceed the B content by 2% when the W, Mo and B masses are each converted to a mole-based value. The right-hand side of the formula (2), i.e., the W and Mo contents (% by weight) which contribute to solid solution and precipitation hardening is preferably in a range of 2.0 to 4.0, and more preferably in a range of 2.5 to 3.5.

The martensitic heat resistant alloy according to the second aspect of the present application has the same composition range (A) as the alloy according to the aforementioned first aspect of the present invention. In the alloy of the second aspect of the present invention, the contents of B and Al (B) is set so that the mole-based ratio of the B content to the Al content (B/Al) is 2.5 or more. By this feature, the creep rupture strength at a high temperature and ductility can be significantly enhanced. The mole-based ratio (B/Al) is preferably in a range of 2.5 to 20, and more preferably in a range of 5.0 to 15.

Further, the martensitic heat resistant alloy of the invention of the present application may satisfy both of the conditions of the first and second aspects. Specifically, in such a martensitic heat resistant alloy, the composition thereof has the same composition range (A) as the alloys of the aforementioned first and second aspects of the present invention, (B) the Mo, W, B and N contents (% by weight) thereof satisfy the aforementioned formulae (1) and (2), and the mole-based ratio of the B content to the Al content (B/Al) is 2.5 or more. As a result, a martensitic heat resistant alloy, having significantly enhanced creep rupture strength at a high temperature and ductility, can be realized.

The martensitic heat resistant alloy of the invention of the present application may further include, % by weight, at least one type of element selected from the group consisting of: no more than 0.1% of Ni; and no more than 0.1% of Cu. And/or, the martensitic heat resistant alloy of the present invention may further include, % by weight, no more than 0.03% of P; no more than 0.01% of S; and no more than 0.02% of O.

Both Ni and Cu are austenite formers. Accordingly, in a case in which the formation of δ ferrite is to be suppressed and further enhancement of toughness is to be effected, at least one type of element selected from Ni and Cu may optionally be added. It should be noted that, if the content thereof (Ni, Cu) exceeds 0.1% by weight, the creep rupture strength is decreased. The Ni content is preferably in a range of 0.0005 to 0.05% by weight, and more preferably in a range of 0.001 to 0.02% by weight. The Cu content is preferably in a range of 0.0005 to 0.01% by weight, and more preferably in a range of 0.0005 to 0.007% by weight.

P, S and O are unavoidable impurities, and the lower the contents thereof are, the more preferable. The P content, the S content and the O content exceeding 0.03% by weight, 0.01% by weight and 0.02% by weight, respectively, are not preferable because the advantageous properties of the alloy of the invention of the present application may then be lost. The P content is preferably in a range of 0.0001 to 0.03% by weight, and more preferably in a range of 0.0001 to 0.005% by weight. The s content is preferably in a range of 0.0001 to 0.01% by weight, and more preferably in a range of 0.0001 to 0.001% by weight. The O content is preferably in a range of 0.0001 to 0.02% by weight, and more preferably in a range of 0.0001 to 0.005% by weight.

In the present invention, by employing the aforementioned unique composition in which the conventional components system is specifically adjusted, the effect by the components is maximized and the creep strength at a high temperature can be drastically enhanced, without any necessity of adding expensive elements.

On the basis of the features described above, but from another point of view, it can be stated that the invention of the present application specifically provides a novel martensitic heat resistant; alloy, being completely unknown in the prior art and having creep strength property at a high temperature in which the creep rupture time is no shorter than 3,800 hours at 650° C. and under a stress of 100 MPa, or even no shorter than 20,000 hours at the same condition.

Further, the invention of the present application also provides a heat resistant alloy, having creep strength property in which the creep rupture strength in a range of rupture time of 100,000 hours at 650° C. is 80 MPa or more.

Yet further, the invention of the present application provides a method for producing the aforementioned martensitic heat resistant alloy, the method comprising the steps of: subjecting the alloy material having the composition range described above to a normalizing process in which the alloy material is heated to a temperature in a range of 1050 to 1200° C., retained therein and cooled; and the subjecting the alloy material to a tempering process in which the alloy material is heated to a temperature in a range of 750 to 850° C., retained therein and cooled.

In order to fully obtain the excellent effect achieved by the composition of the invention of the present application, the temperature during the normalizing process is to be set in a range of 1050 to 1200° C. When the temperature is lower than 1050° C., carbonitrides are not soluble in a satisfactory manner and the minute carbonitrides dispersed structure cannot be obtained after the tempering process. When the temperature exceeds 1200° C., the amount of formation of δ ferrite is increased and thus the strength and toughness of the alloy are deteriorated. The retaining time in the normalizing process is to be no shorter than 15 minutes because, if the retaining time is less than 15 minutes, the normalizing effect will be insufficient.

The temperature during the tempering process is to be set in a range of 750 to 850° C. When the temperature in lower than 750° C., the creep rupture strength in a range of relatively long rupture time may significantly decrease because recovery of excessive dislocation is not fully effected. When the temperature exceeds 850° C., the creep rupture strength may significantly decrease because of the reverse transformation to austenite. The retaining time is to be no shorter than 15 minutes because, if the retaining time is less than 15 minutes, the tempering effect will be insufficient.

In producing the martensitic heat resistant alloy of the invention of the present application, no specific production technique is required. Therefore, there is no significant increase in the production cost of the alloy of the preset invention, as compared with the alloy of the prior art.

As a result, the creep rupture strength at a high temperature is drastically enhanced, the heat and pressure resistant members used in the fields of boiler and turbine for power generation, nuclear power generation facilities and chemical industries are made more reliable and can be used for a longer period at a high temperature, life duration of plants of various types can be prolonged, the production and running costs can be reduced, and thus more efficient facilities can be realized. Realization of more efficient facilities will bring a favorable effect of using less natural resources and protecting the environment of the earth.

The embodiment of the present invention will be further described in detail by the following example.

EXAMPLE

Table 1 shows the chemical composition (% by weight) of each of the alloys according to the invention of the present application and the conventional alloys prepared for comparative purpose.

TABLE 1

| | C | Si | Mn | P | S | Cr | W | Mo | V | Nb | Co | N | B | Al | O | Ni | Cu |
|---|---|---|---|---|---|---|---|---|---|---|---|---|---|---|---|---|---|
| Comparative alloy 1 | 0.09 | 0.31 | 0.50 | 0.001 | 0.001 | 8.94 | 2.94 | 0.01 | 0.19 | 0.05 | 3.03 | 0.0018 | — | 0.005 | 0.003 | 0.01 | 0.003 |
| Comparative alloy 2 | 0.08 | 0.29 | 0.51 | 0.001 | 0.001 | 8.95 | 2.93 | 0.01 | 0.19 | 0.05 | 3.04 | 0.0010 | 0.0047 | 0.005 | 0.003 | 0.01 | 0.004 |
| Present alloy 1 | 0.08 | 0.29 | 0.50 | 0.001 | 0.001 | 8.96 | 2.92 | 0.01 | 0.19 | 0.05 | 3.01 | 0.0015 | 0.0091 | 0.007 | 0.003 | 0.01 | 0.004 |
| Present alloy 2 | 0.09 | 0.30 | 0.51 | 0.001 | 0.001 | 8.99 | 2.91 | 0.01 | 0.19 | 0.05 | 3.01 | 0.0033 | 0.0136 | 0.003 | 0.002 | 0.01 | 0.003 |
| Present alloy 3 | 0.08 | 0.58 | 0.50 | 0.001 | 0.001 | 8.90 | 2.99 | 0.01 | 0.19 | 0.05 | 3.04 | 0.0017 | 0.0093 | 0.002 | 0.005 | 0.01 | 0.003 |
| Conventional 9Cr steel | 0.09 | 0.34 | 0.45 | 0.015 | 0.001 | 8.51 | — | 0.90 | 0.21 | 0.08 | — | 0.0420 | — | 0.020 | 0.010 | 0.20 | 0.026 |

100 kg of each alloy material having each composition shown in Table 1 was vacuum melted and then made to have an ingot-shape. Each ingot was subjected to hot forging and hot rolling, so as to have plate-like shape (thickness 20 mm×width: 110 mm). During the production process, no cracking or the like was generated due to the hot forging and hot rolling. Accordingly, it was confirmed that the alloy according to the invention of the present application has excellent hot workability.

Each alloy plate was subjected to a normalizing process in which the plate was heated to a temperature in a range of 1050 to 1080° C., retained in the temperature range for 1 hour and air-cooled. The alloy plate was then subjected to a tempering process in which the plate was heated to a temperature in a range of 790 to 825° C., retained in the temperature range for 1 hour and air-cooled. All of the alloys were 100% tempered martensitic. Creep test pieces having diameter of 10 mm and GL of 50 mm were cut out from each of the obtained alloy materials. A creep rupture test was conducted for approximately 10,000 hours at 650° C. under various stress conditions. The state of oxidation at the surface of the ruptured material was observed, and the creep rupture strength, the rupture elongation, and the reduction in area at the time of rupture were compared between the present alloys and the comparative alloys.

From the results, it was confirmed that the alloy of the present invention experiences less generation of oxide scale during hot processing and exhibits excellent hot workability and oxidation resistance.

Table 2 shows the values obtained by the formulae (1) and (2) and the mole-based ratio (B/Al), of each of the comparative alloys, the present alloys and the conventional 9Cr steel.

The results are shown in Table 3 and FIG. 1.

TABLE 2

| Added element/Type of alloy | B | N | Al | W | Mo | Formula (1) | Formula (2) | (B/Al) |
|---|---|---|---|---|---|---|---|---|
| Comparative alloy 1 | 0 | 0.0018 | 0.005 | 2.94 | 0.01 | −0.0014 | 2.96 | 0 |
| Comparative alloy 2 | 0.0047 | 0.0010 | 0.005 | 2.93 | 0.01 | 0.0039 | 2.87 | 2.34 |
| Present alloy 1 | 0.0091 | 0.0015 | 0.007 | 2.92 | 0.01 | 0.0079 | 2.78 | 3.24 |
| Present alloy 2 | 0.0136 | 0.0033 | 0.003 | 2.91 | 0.01 | 0.0111 | 2.70 | 11.3 |
| Present alloy 3 | 0.0093 | 0.0017 | 0.002 | 2.99 | 0.01 | 0.0080 | 2.85 | 11.6 |
| Conventional 9Cr steel | 0 | 0.0420 | 0.020 | 0 | 0.90 | −0.0324 | 1.72 | 0 |

TABLE 3

| | Test stress | | | | | | | | | | | |
|---|---|---|---|---|---|---|---|---|---|---|---|---|
| | 160 MPa | | | 140 MPa | | | 110 MPa | | | 100 MPa | | |
| Type of alloy | Tr | Elon. | RA | Tr | Elon. | RA | Tr | Elon. | RA | Tr | Elon. | RA |
| Comparative alloy 1 | 19 | | | 93 | 33 | 90 | 1505 | 21 | 69 | 2319 | 25 | 68 |
| Comparative alloy 2 | 16 | 41 | 92 | 69 | 46 | 94 | 2374 | 23 | 84 | 3029 | 37 | 90 |
| Present alloy 1 | 15 | 39 | 93 | 47 | 39 | 92 | 1330 | 30 | 88 | 3818 | 32 | 88 |
| Present alloy 2 | 73 | 27 | 88 | 322 | 34 | 91 | 12007 | 19 | 75 | | | |
| Present alloy 3 | | | | 40 | 48 | 94 | 1452 | 22 | 87 | 8238 | 22 | 83 |
| Conventional 9Cr steel | | | | | | | 326 | 35 | 95 | 831 | 26 | 92 |

TABLE 3-continued

| Type of alloy | Test stress | | | | | | | | |
|---|---|---|---|---|---|---|---|---|---|
| | 90 MPa | | | 80 MPa | | | 60 MPa | | |
| | Tr | Elon. | RA | Tr | Elon. | RA | Tr | Elon. | RA |
| Comparative alloy 1 | 3479 | 26 | 59 | 5476 | 19 | 48 | | | |
| Comparative alloy 2 | 5199 | 30 | 85 | 10955 | | | | | |
| Present alloy 1 | 12014 | 32 | 85 | | | | | | |
| Present alloy 2 | | | | | | | | | |
| Present alloy 3 | | | | | | | | | |
| Conventional 9Cr steel | | | | 6053 | 19 | 77 | 27728 | 13 | 36 |

("Tr": Rupture time (hour), "Elon": Rupture elongation (%), "RA": Rupture reduction in area (%))

The creep rupture time of any of the present alloys is 4 to 30 times or more as long as the creep rupture time of the conventional alloys, when comparison is made in a range of rupture time of 1000 hours or more. In the comparative alloy 1 in which the N content was reduced and the B content was nil, the creep strength is decreased, in a range of rupture time of 5000 hours or more, to the level equal to the conventional alloy in which the content was not reduced, although the creep strength is relatively high in a range of relatively short rupture time. In the comparative alloy 2 in which the B content was 0.0047% by weight, a sharp decrease in creep rupture strength in a range of relatively long rupture time, which is said to be one of the characteristics exhibited by the conventional ferritic heat resistant alloy at 650° C., was observed, although the strength thereof was generally higher than that of the conventional alloy. However, in the present alloys, such a sharp decrease in creep rupture strength was not observed. The creep strength which would cause rupture after 100,000 hours, which was assumed from the graph of the creep rupture strength in a range of rupture time of 0 to 10,000 hours, is 30 to 50 MPa in the conventional alloys, while 80 to 100 MPa in the present alloys. That is, the magnitude of the creep strength or stress which would cause rupture after 100,000 hours to the present alloy is approximately twice as large as that of the conventional alloys. In other words, the time period required for the present alloys to cause rupture is indeed 10 to 100 times or more as long as the time period required for the conventional alloys to cause rupture. On the other hand, the values of rupture elongation and reduction in area at the time of rupture of the present alloys are substantially the same as the corresponding values of the comparative and conventional alloys. This result indicates that the rupture ductility and the like of the present alloy are not deteriorated, as compared with the comparative or conventional alloys.

As is apparent from the aforementioned description, the present invention provides, as a novel martensitic heat resistant alloy which is unknown in the prior art, a heat resistant alloy having creep strength property at a high temperature in which the creep rupture time is no shorter than 3,800 hours at 650° C. and under the stress of 100 MPa and also, as an improvement of the alloy, a heat resistant alloy having creep strength property at a high temperature in which the creep rupture time is no shorter than 20,000 hours at 650° C. and under the stress of 100 MPa.

When the state of oxidation at the surface of the creep ruptured material was observed, no peeling or the like caused by the oxidation was found at the surface of the present alloys. This result indicates that the present alloys have excellent oxidation resistance.

Figure 2:
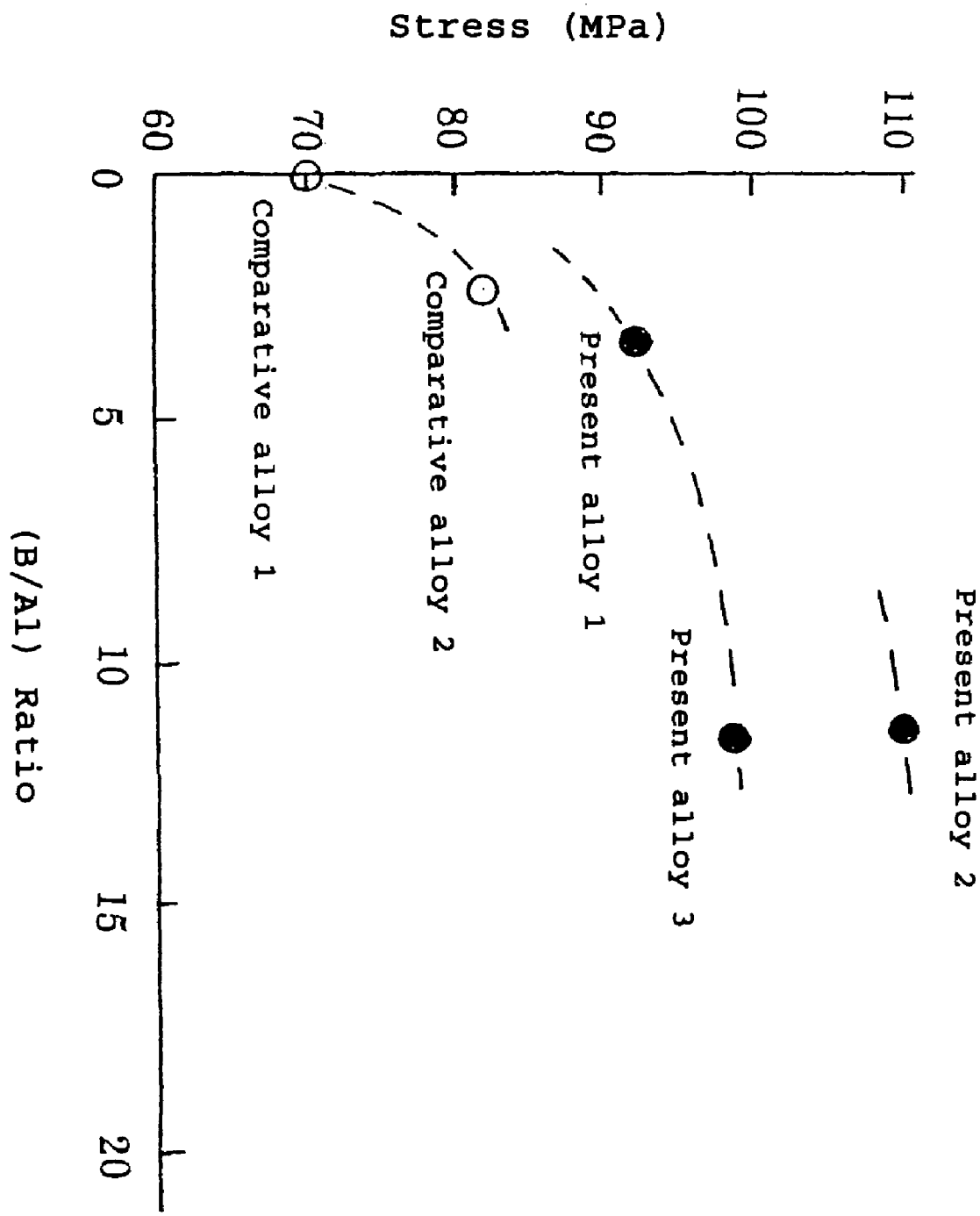
FIG. 2 is a graph showing the relationship between the creep rupture strength (650° C., 10,000 hours) and the (B/Al) ratio, in the alloy of the present invention and the comparative alloy, respectively.

FIG. 2 is a graph showing the relationship between the creep rupture strength (the stress which causes rapture) after 10,000 hours at 650° C. obtained FIG. 1 and the mole-based ratio (B/Al). As is obvious from FIG. 2, the strength is significantly increased when the (B/Al) ratio is 2.5 or more, and gently increased when the (B/Al) ratio is relatively high. It is also understood that the higher the B content, the more the creep rupture strength of the alloy is increased.

Figure 3:
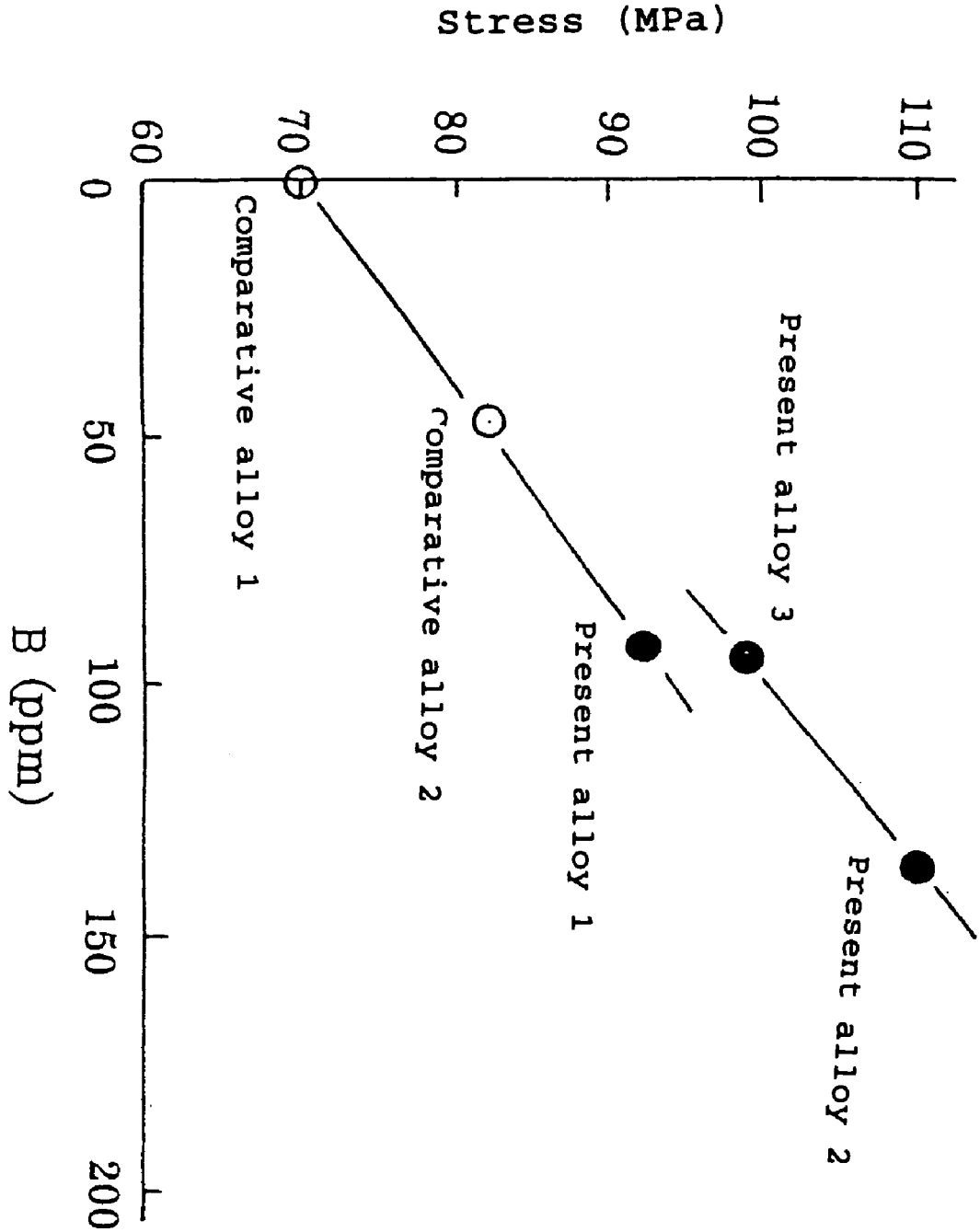
FIG. 3 is a graph showing the relationship between the creep rupture strength (650° C., 10,000 hours) and the B content, in the alloy of the present invention and the comparative alloy, respectively.

FIG. 3 is a graph showing the relationship between the creep rupture strength after 10,000 hours at 650° C. obtained from FIG. 1 and the B content. As is obvious from FIG. 3, the creep rupture strength is linearly increased as the B content is increased. It should be noted that the present alloys whose (B/Al) ratio is high i.e., 11 or more exhibit high strength, as compared with the alloys whose (B/Al) ratio is 3.3 or less.

Figure 4:
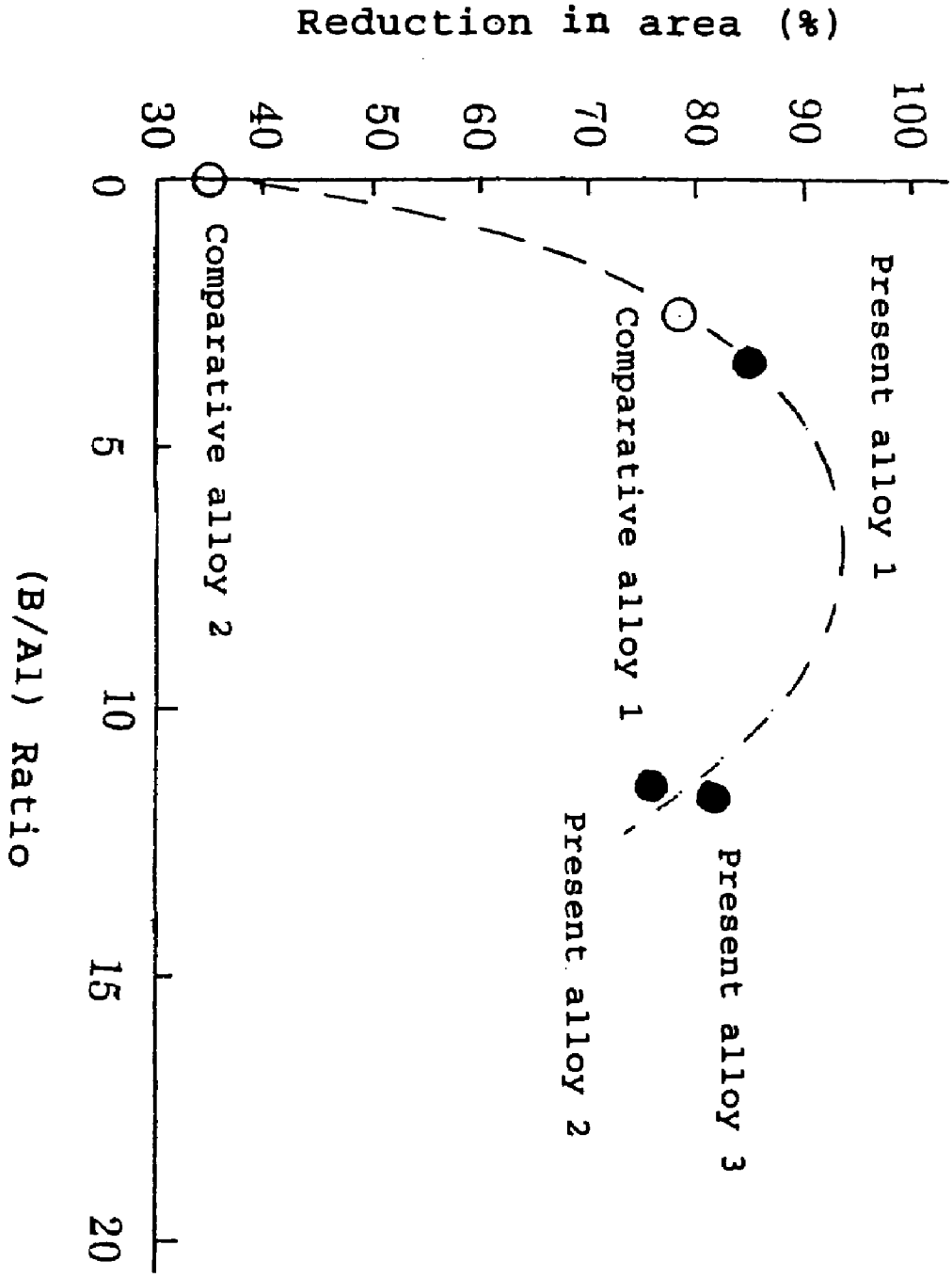
FIG. 4 is a graph showing the relationship between the percentage reduction in area at the time of the creep rupture (650° C., 10,000 hours) and the (B/Al) ratio, in the alloy of the present invention and the comparative alloy, respectively.

FIG. 4 is a graph showing the relationship between the mole-based ratio (B/Al) and the percentage reduction in area after 10,000 hours, which percentage reduction in area after 10,000 hours is obtained from the value of rupture time and percentage reduction in area shown in Table 3. As shown in FIG. 4, the percentage reduction in area is highest when the mole-based ratio (B/Al) is in a range of 2.5 to 12.5.

Figure 5:
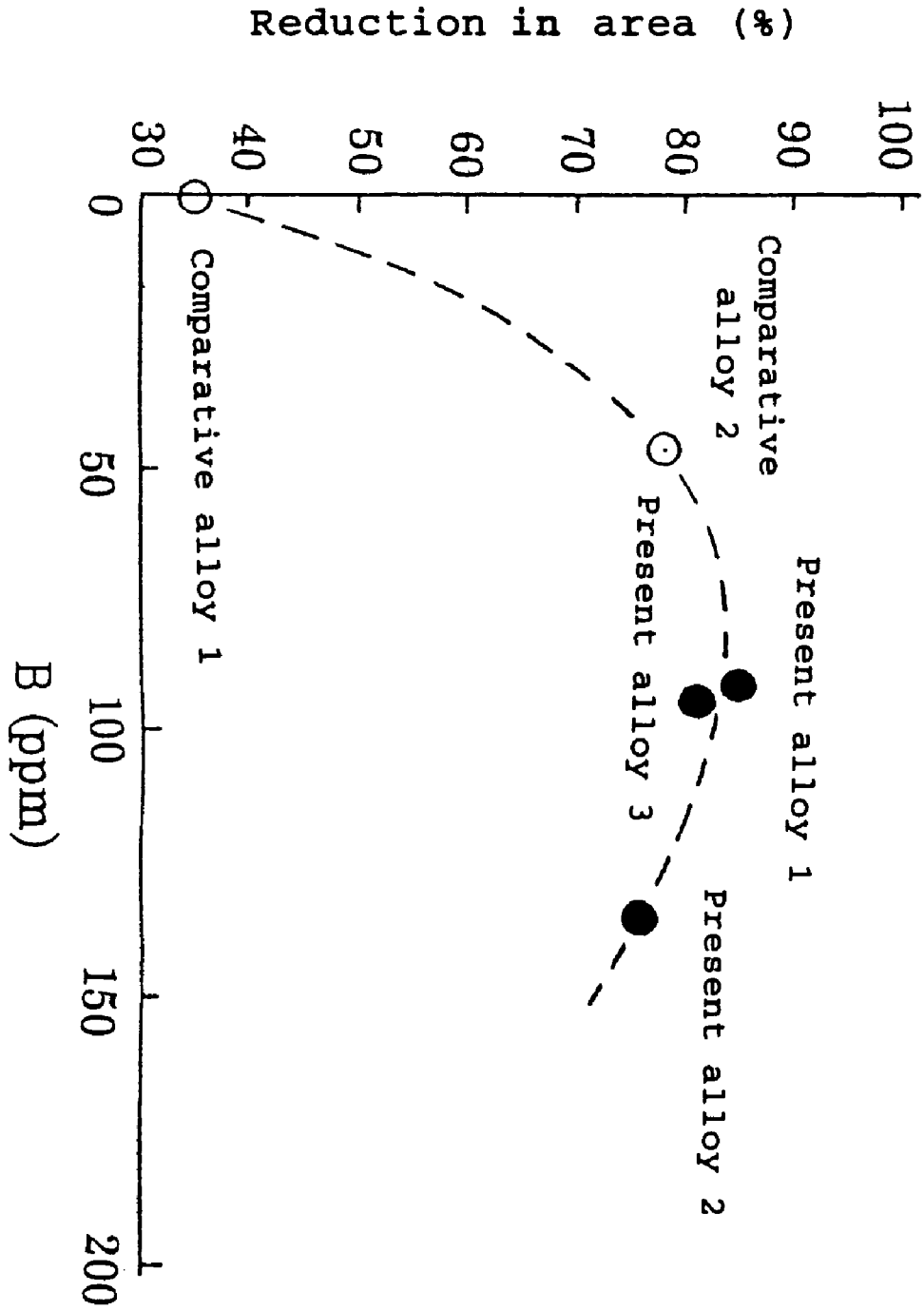
FIG. 5 is a graph showing the relationship between the percentage reduction in area at the time of the creep rupture (650° C., 10,000 hours) and the B content, in the alloy of the present invention and the comparative alloy, respectively.

FIG. 5 is a graph showing the relationship between the percentage reduction in area of FIG. 4 and the B content. The percentage reduction in area is significantly increased as the B content is increased, and becomes especially high when the B content, is 50 ppm or more. By analyzing the relationship between the values of rupture time and percentage reduction in area shown in Table 3, it is understood that the comparative alloy 1 exhibits a rapid decline of percentage reduction in area in a range of rupture time of 1,000 hours or more , and the comparative alloy 2 exhibits a rapid decline of percentage reduction in area in a range of rupture time of 10,000 hours or more. In the aforementioned relationship, the percentage reduction in area of any of the present alloy is gently decreased as time passes even in a range of rupture time of 10,000 hours, and is still quite high i.e., 75% or more after 10,000 hours.

By producing a header connecting pipe between the secondary superheating pipe outlet and the quaternary superheating pipe outlet, as well as a thick steel pipe having large diameter such as the main steam pipe, of a boiler whose steam temperature is 650° C. or higher, by using the alloys of the present invention described above, a ultra supercritical pressure boiler which is more reliable than the conventional model can be manufactured. For the aforementioned superheating pipes, 18Cr10Ni-based high strength austenitic steel is employed. As the alloy of the invention of the present application is a martensitic alloy and therefore has a smaller coefficient of thermal expansion than austenitic steel, superheating pipes made of the alloy of the present invention can exhibit higher durability against thermal fatigue caused by repeated starting-up and stopping operations. Further, as described above the alloy of the invention of the present application exhibits a high percentage reduction in area in a range of relatively long rupture time. Therefore, the superheating pipes made of the alloy of the present invention are less likely to become brittle even in the harsh conditions in which these pipes are used. In other words, generation of cracks in the superheating pipes can be very effectively prevented.

The present invention is not limited to the present alloys as exemplified above, and various modifications of details may be done within the spirit of the invention.

INDUSTRIAL APPLICABILITY

As described above in detail, the present invention provides a martensitic heat resistant alloy exhibiting excellent creep rupture strength in a range of relatively long rupture time at a high temperature, being excellent in oxidation resistance, hot workability and ductility as well as a method for producing the same.

As the creep rupture strength and ductility are drastically enhanced, the heat and pressure resistant members used in the fields of boiler and turbine for power generation, nuclear power generation facilities and chemical industries are made more reliable and can be used for a longer period at a high temperature. Thus, more efficient facilities can be realized.

Further, due to the excellent strength and ductility obtained as a result of the specific designing of the alloy composition of the present invention, life duration of plants of various types can be prolonged, the production and running costs can be reduced and more efficient facilities can be realized without relying on any specific production technique, whereby a favorable effect of using less natural resources and protecting the environment of the earth can be obtained.

The invention claimed is:

1. A martensitic heat resistant alloy having a composition (A) comprising, % by weight:

0.03 to 0.15% of C;
0.2 to 0.9% of Si;
0.01 to 1.5% of Mn;
8.0 to 13.0% of Cr;
0.0005 to 0.015% of Al;
no more than 2.0% of Mo;
no more than 4.0% of W;
0.05 to 0.5% of V;
0.01 to 0.2% of Nb;
0.1 to 5.0% of Co;
0.008 to 0.03% of B;
less than 0.005% of N: and
Fe and inevitable impurities as the remainder,
wherein (B) the contents (% by weight) of Mo, W, B and N satisfy the following formulae (1) and (2), $$B-0.772N>0.007 \quad (1)$$

$$W+1.916Mo-16.99B>2.0 \quad (2).$$

2. A martensitic heat resistant alloy having a composition (A) comprising, % by weight:

0.03 to 0.15% of C;
0.2 to 0.9% of Si;
0.01 to 1.5% of Mn;
8.0 to 13.0% of Cr;
0.0005 to 0.015% of Al;
no more than 2.0% of Mo;
no more than 4.0% of W;
0.05 to 0.5% of V;
0.01 to 0.2% of Nb;
0.1 to 5.0% of Co;
0.008 to 0.03% of B;
less than 0.005% of N: and
Fe and inevitable impurities as the remainder,
wherein (B) the mole-based ratio of the content of B with respect to the content of Al, (B/Al), is no smaller than 2.5.

3. The martensitic heat resistant alloy having a composition (A) comprising, % by weight:

0.03 to 0.15% of C;
0.2 to 0.9% of Si;
0.01 to 1.5% of Mn;
8.0 to 13.0% of Cr;
0.0005 to 0.015% of Al;
no more than 2.0% of Mo;
no more than 4.0% of W;
0.05 to 0.5% of V;
0.01 to 0.2% of Nb;
0.1 to 5.0% of Co;
0.008 to 0.03% of B;
less than 0.005% of N: and
Fe and inevitable impurities as the remainder,
wherein (B) the contents (% by weight) of Mo, W, B and N satisfy the following formulae (1) and (2), $$B-0.772N>0.007 \quad (1)$$

$$W+1.916Mo-16.99B>2.0 \quad (2), \text{ and}$$

the mole-based ratio of the content of B with respect to the content of Al, (B/Al), is no smaller than 2.5.

4. The martensitic heat resistant alloy according to claim 1, the composition thereof further comprising, % by weight, at least one type of element selected from the group consisting of: no more than 0.1% of Ni; and no more than 0.1% of Cu.

5. The martensitic heat resistant alloy according to claim 1, the composition thereof further comprising, % by weight, no more than 0.03% of P; no more than 0.0 1% of S; and no more than 0.02% of O.

6. A method for producing a martensitic heat resistant alloy, comprising:

subjecting the alloy material having the composition according to claim 1, to a normalizing process in which the alloy material is heated to a temperature in a range of 1050 to 1200° C., retained therein and cooled; and then subjecting the alloy material to a tempering process in which the alloy material is heated to a temperature in a range of 750 to 850° C., retained therein and cooled.

7. The martensitic heat resistant alloy according to claim 2, the composition thereof further comprising, % by weight, at least one type of element selected from the group consisting of: no more than 0.1% of Ni; and no more than 0.1% of Cu.

8. The martensitic heat resistant alloy according to claim 3, the composition thereof further comprising, % by weight, at least one type of element selected from the group consisting of: no more than 0.1% of Ni; and no more than 0.1% of Cu.

9. The martensitic heat resistant alloy according to claim 2, the composition thereof further comprising, % by weight, no more than 0.03% of P; no more than 0.01% of S; and no more than 0.02% of O.

10. The martensitic heat resistant alloy according to claim 3, the composition thereof further comprising, % by weight, no more than 0.03% of P; no more than 0.0 1% of S; and no more than 0.02% of O.

11. The martensitic heat resistant alloy according to claim 4, the composition thereof further comprising, % by weight, no more than 0.03% of P; no more than 0.01% of S; and no more than 0.02% of O.

12. A method for producing a martensitic heat resistant alloy, comprising:

subjecting the alloy material having the composition according to claim 2, to a normalizing process in which the alloy material is heated to a temperature in a range of 1050 to 1200° C., retained therein and cooled; and then subjecting the alloy material to a tempering process in which the alloy material is heated to a temperature in a range of 750 to 850° C., retained therein and cooled.

13. A method for producing a martensitic heat resistant alloy, comprising:

subjecting the alloy material having the composition according to claim 3, to a normalizing process in which the alloy material is heated to a temperature in a range of 1050 to 1200° C., retained therein and cooled; and then subjecting the alloy material to a tempering process in which the alloy material is heated to a temperature in a range of 750 to 850° C., retained therein and cooled.

14. A method for producing a martensitic heat resistant alloy, comprising:

subjecting the alloy material having the composition according to claim 4, to a normalizing process in which the alloy material is heated to a temperature in a range of 1050 to 1200° C., retained therein and cooled; and then subjecting the alloy material to a tempering process in which the alloy material is heated to a temperature in a range of 750 to 850° C., retained therein and cooled.

15. A method for producing a martensitic heat resistant alloy, comprising:

subjecting the alloy material having the composition according to claim 5, to a normalizing process in which the alloy material is heated to a temperature in a range of 1050 to 1200° C., retained therein and cooled; and then subjecting the alloy material to a tempering process in which the alloy material is heated to a temperature in a range of 750 to 850° C., retained therein and cooled.

* * * * *